US007465893B2

(12) United States Patent
Chou

(10) Patent No.: US 7,465,893 B2
(45) Date of Patent: Dec. 16, 2008

(54) ROLLING-BALL SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 73 days.

(21) Appl. No.: 11/633,341

(22) Filed: Dec. 4, 2006

(65) Prior Publication Data

US 2008/0078660 A1 Apr. 3, 2008

(30) Foreign Application Priority Data

Sep. 29, 2006 (TW) ..... 95136375 A

(51) Int. Cl.
*H01H 35/14* (2006.01)

(52) U.S. Cl. ..... 200/61.45 R; 200/61.52

(58) Field of Classification Search ..... 200/61.45 R, 200/61.46, 61.47, 61.48, 61.5, 61.52, 292; 340/546, 429, 565, 566
See application file for complete search history.

(56) References Cited

U.S. PATENT DOCUMENTS 5,136,127 A * 8/1992 Blair ..... 200/61.52
5,669,489 A * 9/1997 von Ende ..... 200/570
6,115,929 A * 9/2000 Tanazawa et al. ..... 33/366.24
6,448,516 B1 * 9/2002 Chiang ..... 200/61.45 R
6,555,772 B1 * 4/2003 Chou ..... 200/61.45 R
6,784,386 B2 * 8/2004 Chou et al. ..... 200/61.51
6,788,201 B2 * 9/2004 Chen et al. ..... 200/61.52
7,067,748 B1 * 6/2006 Kelley et al. ..... 200/61.45 R
7,230,193 B2 * 6/2007 Chou ..... 200/61.45 R

* cited by examiner

*Primary Examiner*—Elvin G Enad
*Assistant Examiner*—Marina Fishman
(74) *Attorney, Agent, or Firm*—Frommer Lawrence & Haug LLP; Ronald R. Santucci

(57) ABSTRACT

A rolling-ball switch includes an insulative housing having a tubular wall that has an axial hole and two opposite open-end portions, and two lead terminals covering respectively the open-end portions. Each open-end portion has an end face and a retaining portion. Each lead terminal is a one-piece conductive body, and is provided with an engaging portion to engage the retaining portion. A ball unit is disposed rollably in the axial hole to contact the lead terminals.

3 Claims, 12 Drawing Sheets

ROLLING-BALL SWITCH

CROSS-REFERENCE TO RELATED APPLICATION

This application claims priority of Taiwanese Application No. 095136375, filed on Sep. 29, 2006.

BACKGROUND OF THE INVENTION

1. Field of the Invention

The invention relates to a switch, more particularly to a rolling-ball switch that is mounted on a circuit board for changing between OFF and ON states.

2. Description of the Related Art

Referring to FIG. 1, a conventional switch 10, as disclosed by the applicant in Taiwanese Patent No. 204790, includes a housing 11, two insulated covers 13 covering two opposite ends of the housing 11, two lead terminals 12 each having one end disposed in the housing 11 and another end that extends through a respective insulated cover 13 and out of the housing 11, and two ball members 14 disposed within the housing 11 and between the two lead terminals 12.

In use, the ball members 14 contact each other as well as the respective one of the lead terminals 12 so as to place the switch 10 in an "ON" state. When an external force is applied to the switch 10, one of the ball members 14 rolls away from the corresponding lead terminal 12, so that the switch 10 is shifted from the "ON" state to an "OFF" state. Since the ball members 14 have multi-directional contact faces, whether the external force applied to the switch 10 is vertical, horizontal, or inclined, the ball members 14 can quickly produce a highly sensitive switching operation so that the conventional switch 10 is very effective, more so than any vibration-type switches.

However, the lead terminals 12 are dependent on the covers 13 for retention on the housing 11, and the presence of the covers 13 only increases the number of components of the switch 10. Further, the lead terminals 12 are only tight-fitted to the covers 13, so that when the switch 10 is subjected to high temperatures, the lead terminals 12 are easily removed from the housing 11.

SUMMARY OF THE INVENTION

Therefore, the object of the present invention is to provide a rolling-ball switch that has a simple and stable structure.

According to this invention, a rolling-ball switch comprises an insulative housing, two lead terminals, and a ball unit. The housing has a tubular wall that has an axial hole and two opposite open-end portions. Each of the open-end portions has an end face and a retaining portion. The lead terminals cover respectively the open-end portions. Each of the lead terminals is a one-piece conductive body, and is provided with an engaging portion to engage the retaining portion. The ball unit is disposed rollably in the axial hole to contact the lead terminals.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
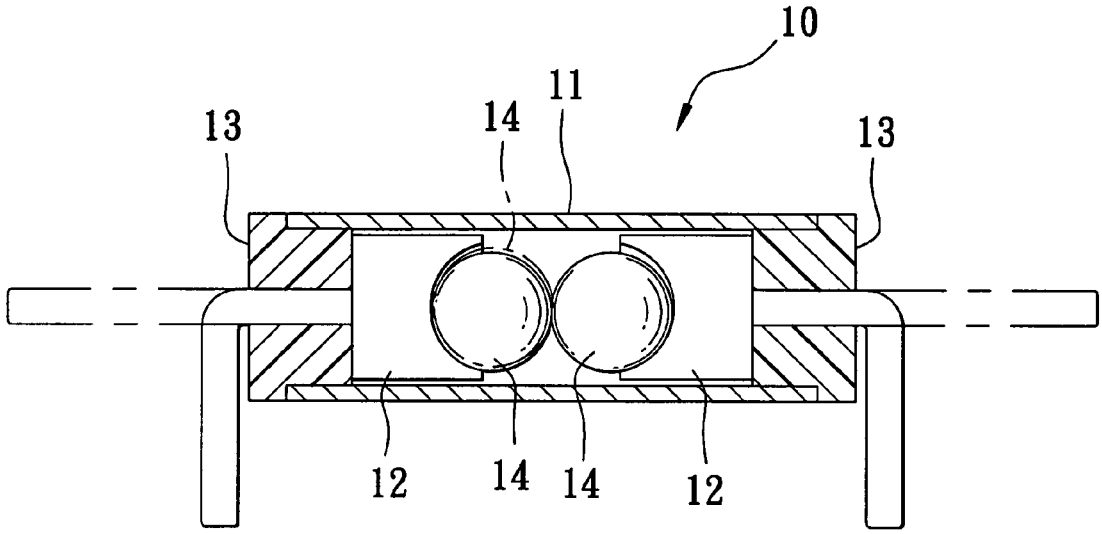
FIG. 1 PRIOR ART
FIG. 1 is a sectional view of a conventional switch as disclosed by the applicant in Taiwanese Patent No. 204790.

Before the present invention is described in greater detail, it should be noted that like elements are denoted by the same reference numerals throughout the disclosure.

Figure 2:
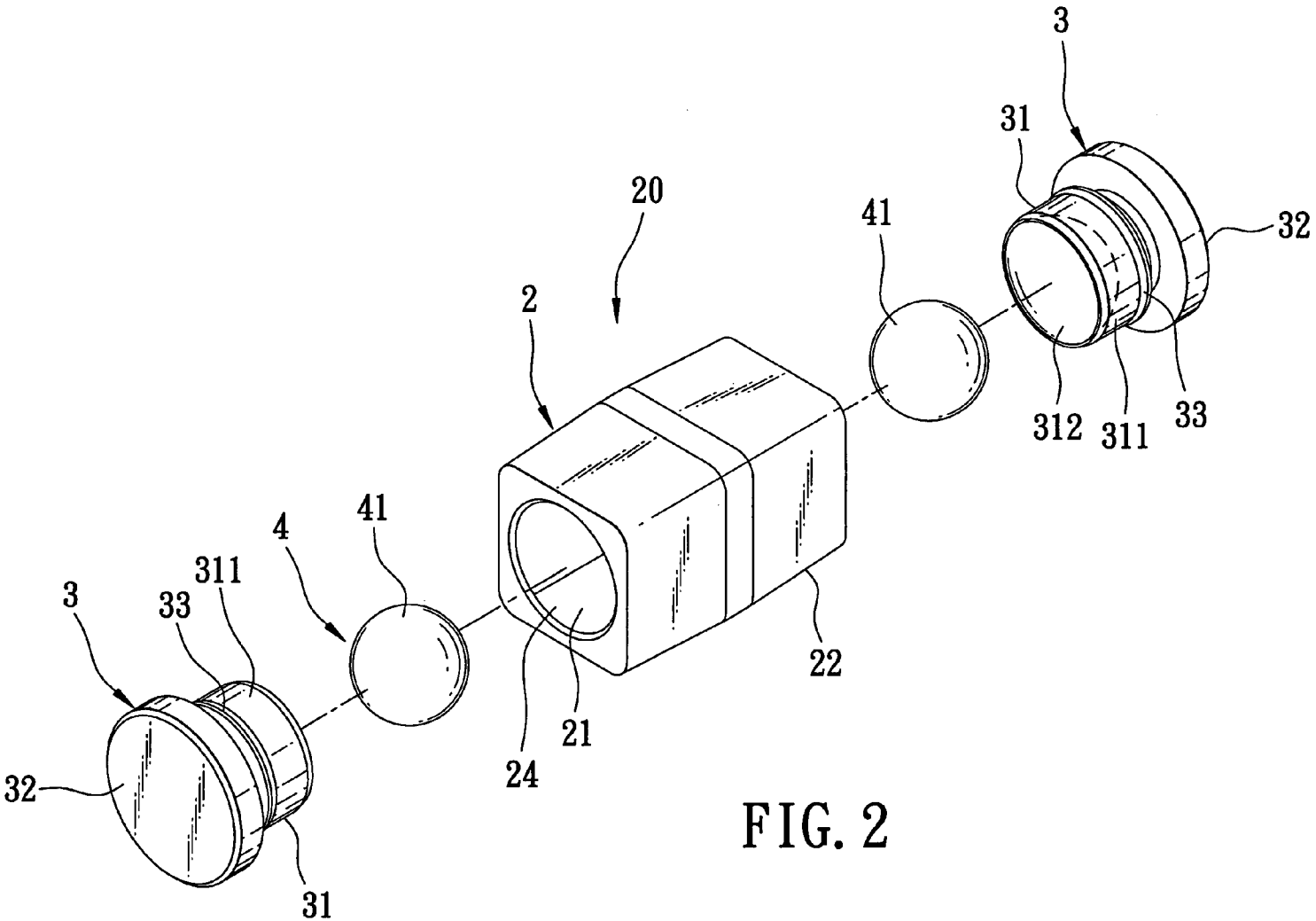
FIG. 2 is an exploded perspective view of the first preferred embodiment of a rolling-ball switch according to the present invention.
Figure 3:
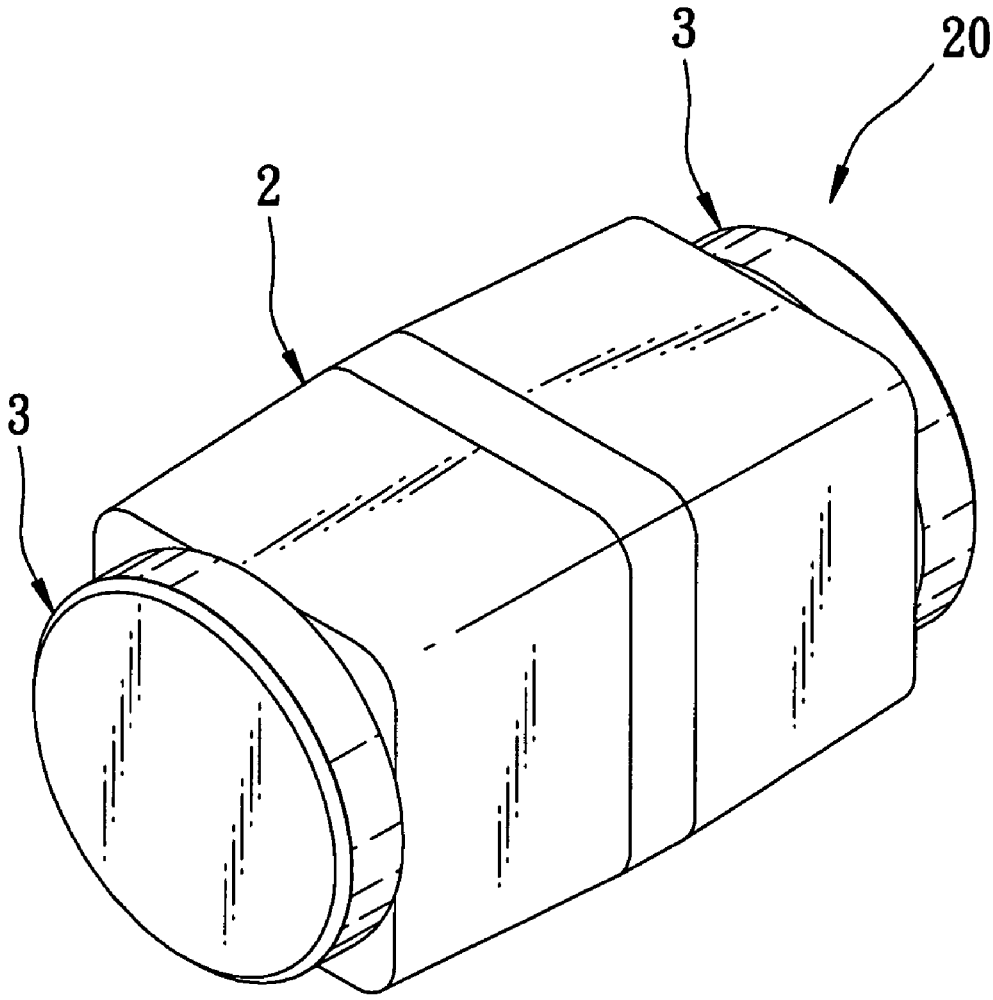
FIG. 3 is an assembled perspective view of the first preferred embodiment.
Figure 4:
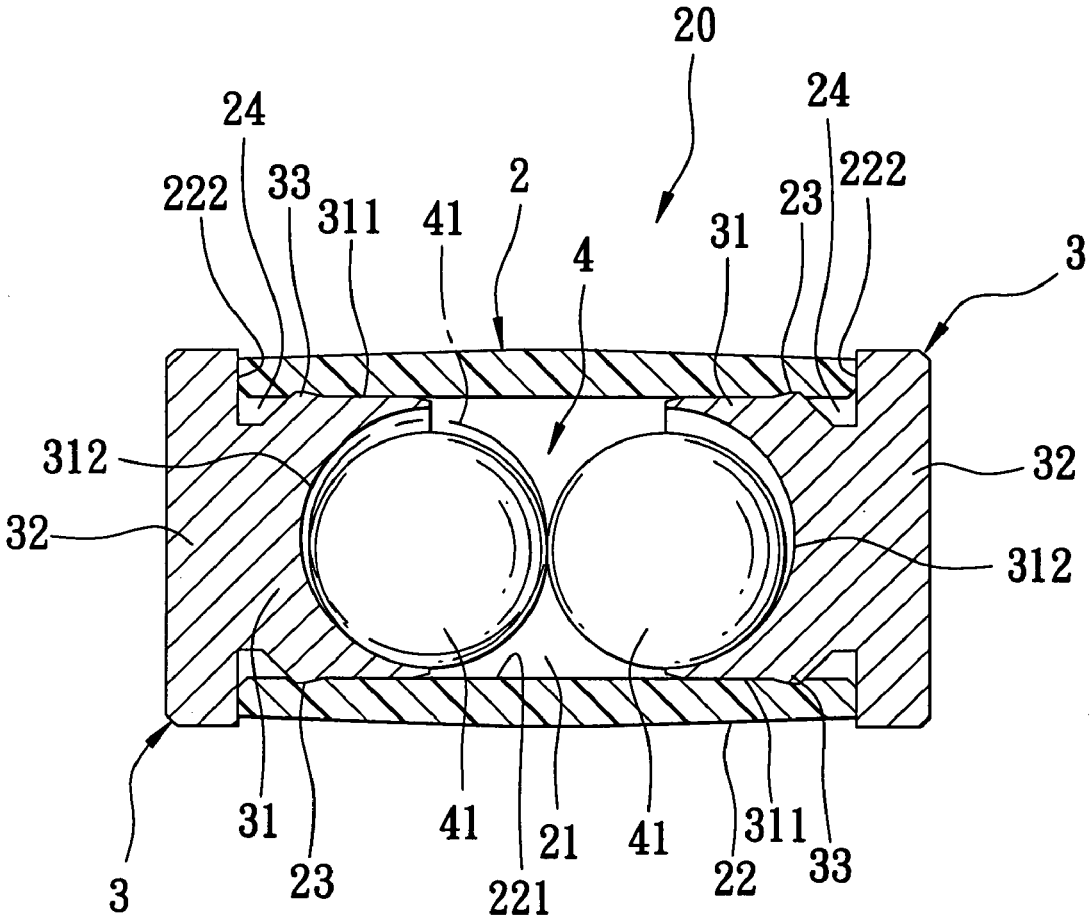
FIG. 4 is an assembled sectional view of the first preferred embodiment.

Referring to FIGS. 2, 3, and 4, the first preferred embodiment of a rolling-ball switch 20 according to the present invention is shown to comprise a housing 2, two lead terminals 3, and a ball unit 4.

The housing 2 is made of plastic, and has a tubular wall 22 defining an axial hole 21, and two opposite open-end portions 24. Each of the open-end portions 24 has an end face 222 and two retaining portions 23. Each of the retaining portions 23, in this embodiment, has an annular engaging groove formed in an inner wall face 221 of the tubular wall 22.

The lead terminals 3 cover respectively the open-end portions 24 of the housing 2. Each of the lead terminals 3 is a one-piece conductive body, and includes an insert portion 31 inserted into the axial hole 21 of the housing 2, and an end cap portion 32 extending from the insert portion 31 and outwardly of the respective open-end portion 24 and abutting against the corresponding end face 222 of the tubular wall 22. The insert portion 31 has an engaging portion 33, and a concave face 312 formed on an inner end thereof. The engaging portion 33, in this embodiment, has an annular protrusion formed on an outer surface 311 of the insert portion 31 to engage the annular engaging groove of the respective retaining portion 23.

The ball unit 4 includes two ball members 41 disposed rollably in the axial hole 21 of the housing 2 and contacting each other between the insert portions 31 of the lead terminals 3.

To assemble the switch 20, the ball members 41 are first placed in the axial hole 21 of the housing 2, followed by insertion of the insert portions 31 of the lead terminals 3 into the axial hole 21 until the end cap portions 32 of the lead terminals 3 abut respectively against the two opposite end faces 222 of the tubular wall 22. At this time, the insert portions 31 of the lead terminals 3 are fitted tightly to the inner wall face 221 of the tubular wall 22, and the engaging portions 33 of the insert portions 31 engage respectively the retaining portions 23 of the housing 2, thereby stably connecting the lead terminals 3 to the housing 2. Not only are the lead terminals 3 fixed stably to the housing 2, the ball members 41 are also limited to roll within the axial hole 21.

In use, surface mount technology (SMT) is used to connect the end cap portions 32 of the lead terminals 3 conductively and respectively to circuit boards. Since the outer surface of the housing 2 at the middle portion 201 thereof is higher than portions at two opposite sides 202 of the middle portion 201, indentations formed on two sides 202 of the middle portion 201 may be filled with a solder material to be flush with the middle portion 201. In normal operation, the ball members 41 contact each other and the respective concave faces 312 of the lead terminals 3 so as to place the switch 20 in an "ON"state. When an external force is applied to the switch 20, one of the ball members 41 rolls away from the respective concave face 312 so as to shift the switch 20 from the "ON"state to an "OFF"state.

Since the ball members 41 have multi-directional contact faces, whether the switch 20 is turned in a vertical, horizontal, or inclined manner, the ball members 41 can quickly produce a highly sensitive switching operation.

Figure 5:
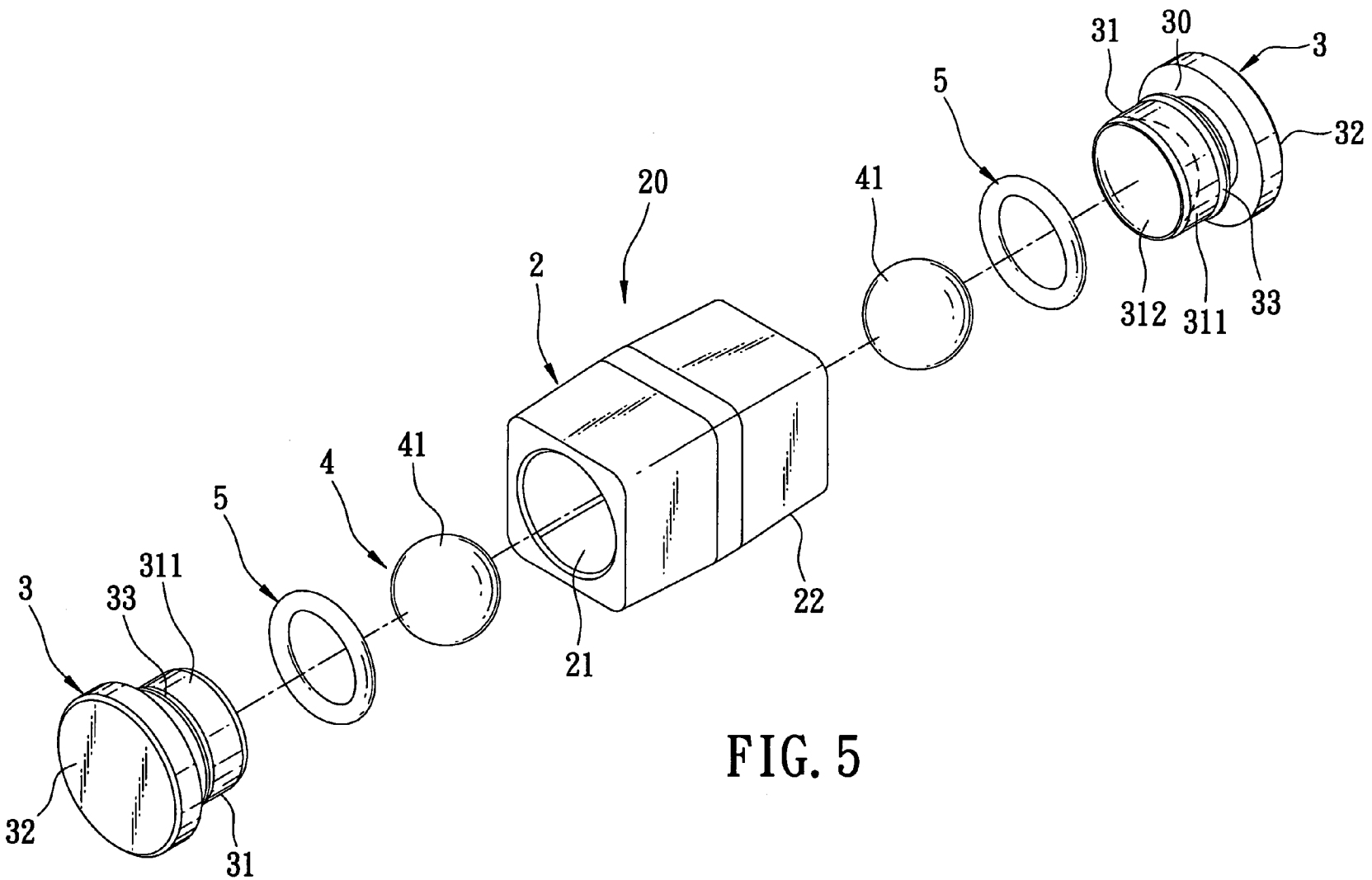
FIG. 5 is a view similar to FIG. 2, but with two sealing gaskets additionally included in the configuration.
Figure 6:
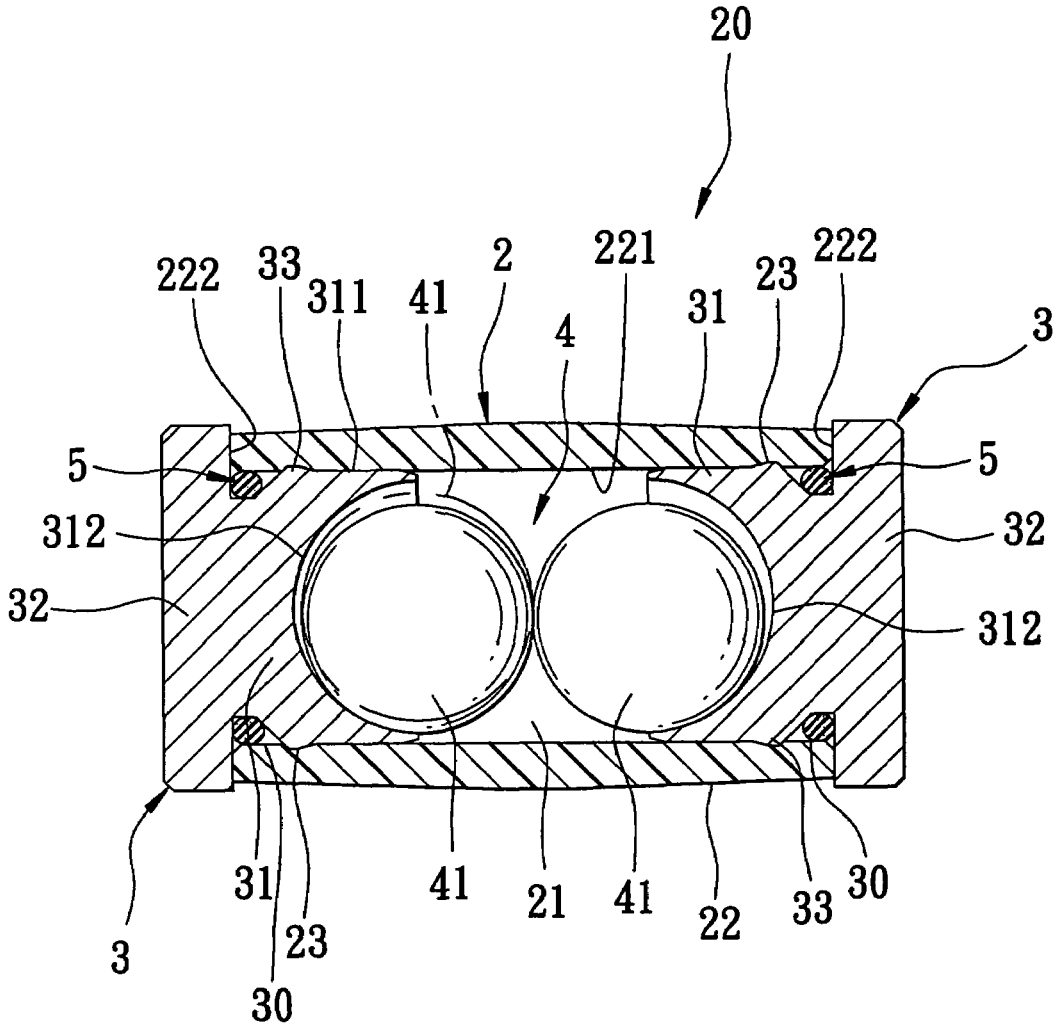
FIG. 6 is a sectional view of FIG. 5 in an assembled state.

Preferably, the insert portion 31 of each lead terminal 3 further has an annular receiving groove 30 adjacent to the end cap portion 32, and a sealing gasket 5 disposed in the annular receiving groove 30, as shown in FIGS. 5 and 6. The sealing gaskets 5 of the insert portions 31 of the lead terminals 3 are disposed respectively in the annular receiving grooves 30 prior to mounting of the lead terminals 3 on the housing 2. When the lead terminals 3 are fitted onto the housing 2, the end cap portions 32 of the lead terminals 3 press respectively against the sealing gaskets 5. As such, a waterproof effect as well as a reduction in the occurrence of oxidation can be achieved.

Figure 7:
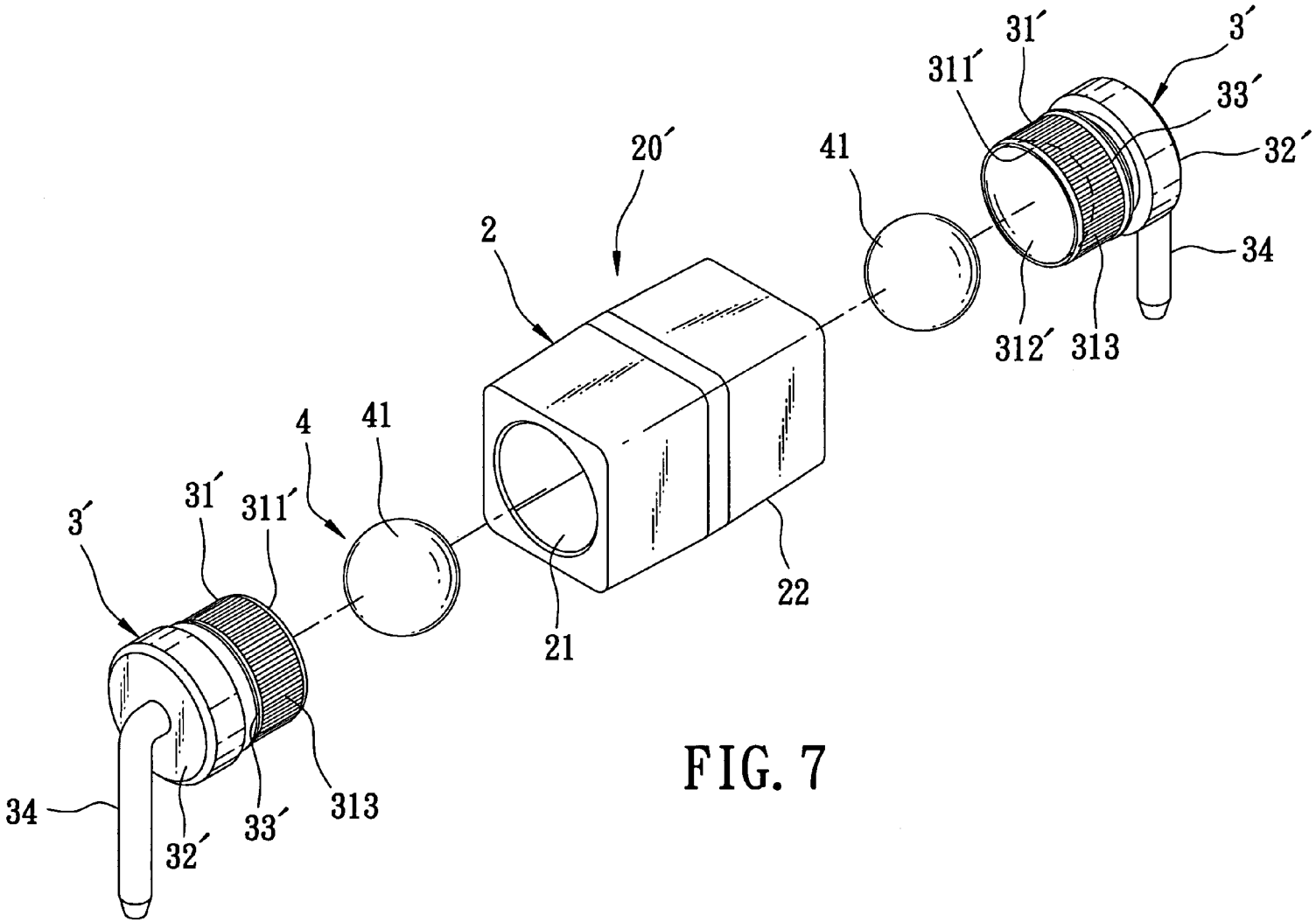
FIG. 7 is an exploded perspective view of the second preferred embodiment of a rolling-ball switch according to the present invention.
Figure 8:
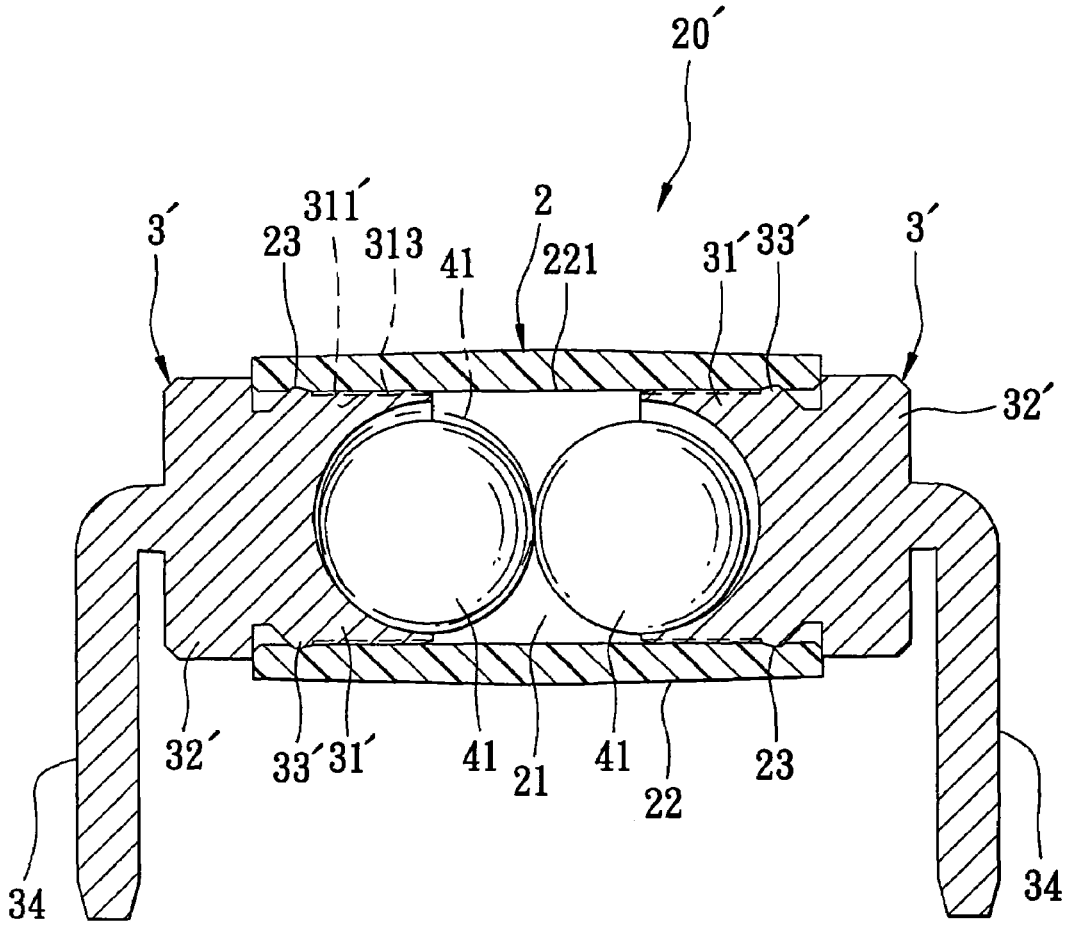
FIG. 8 is an assembled sectional view of the second preferred embodiment.

Referring to FIGS. 7 and 8, the second preferred embodiment of a rolling-ball switch 20' according to the present invention is shown to be similar to the first preferred embodiment. However, in this embodiment, each of the lead terminals 3' further includes a substantially L-shaped connecting leg 34 extending outwardly from the respective end cap portion 32'. The insert portion 31' of each lead terminal 3' further has a plurality of axial ribs 313 formed around the outer surface 311' thereof. The axial ribs 313 maybe formed by an embossment process.

When the insert portions 31' of the lead terminals 3' are press-fitted into the housing 2, the presence of the axial ribs 313 enhances frictional contact between the insert portions 31' and the inner wall face 221 of the housing 2 so that the lead terminals 3' cannot rotate relative to the housing 2. As such, the position and angle of each lead terminal 3' on the housing 2 are stabilized. The switch 20', therefore, can be accurately connected to a circuit board through the connecting legs 34 in a conductive manner.

Figure 9:
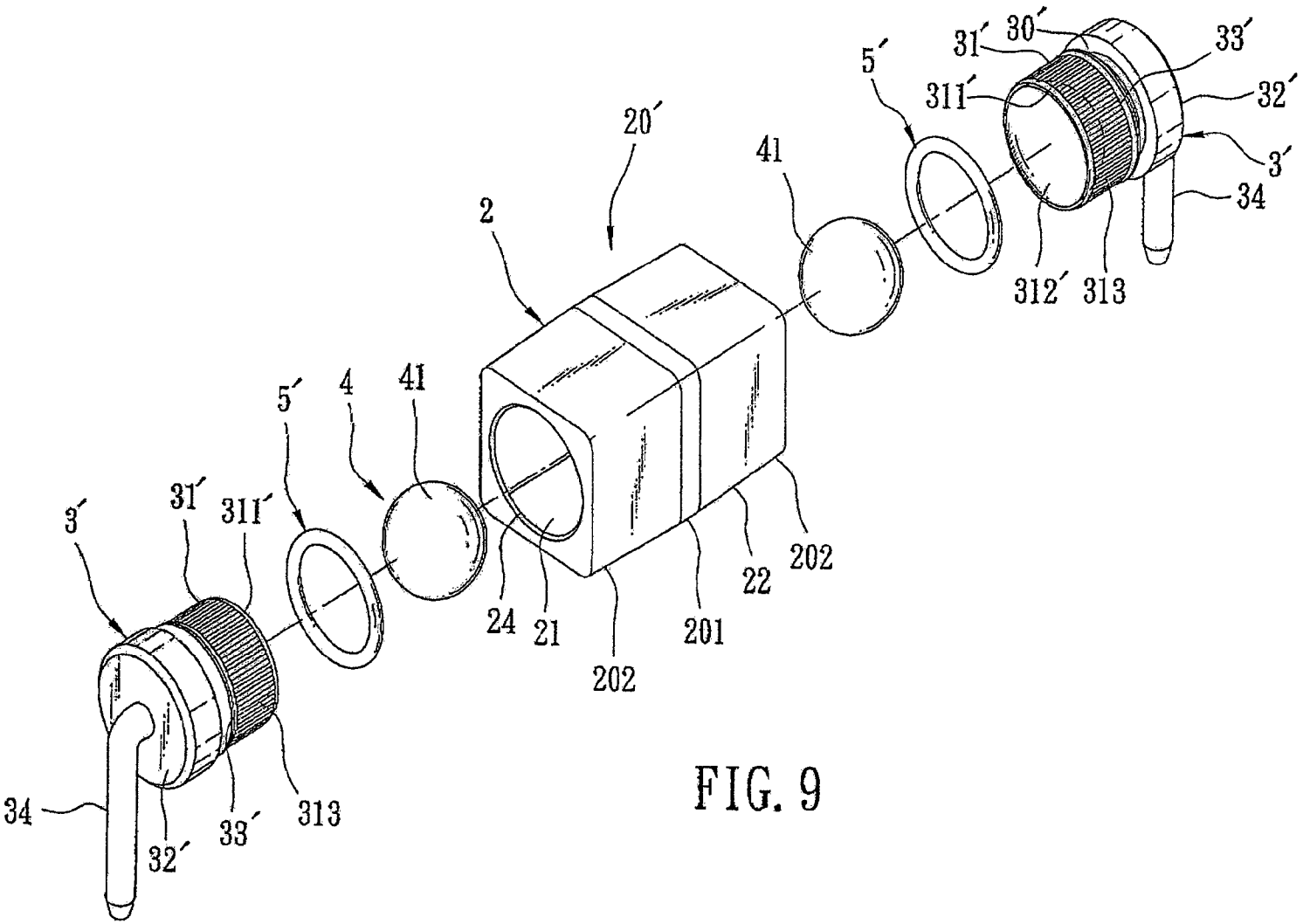
FIG. 9 is a view similar to FIG. 7, but with two sealing gaskets additionally included in the configuration.
Figure 10:
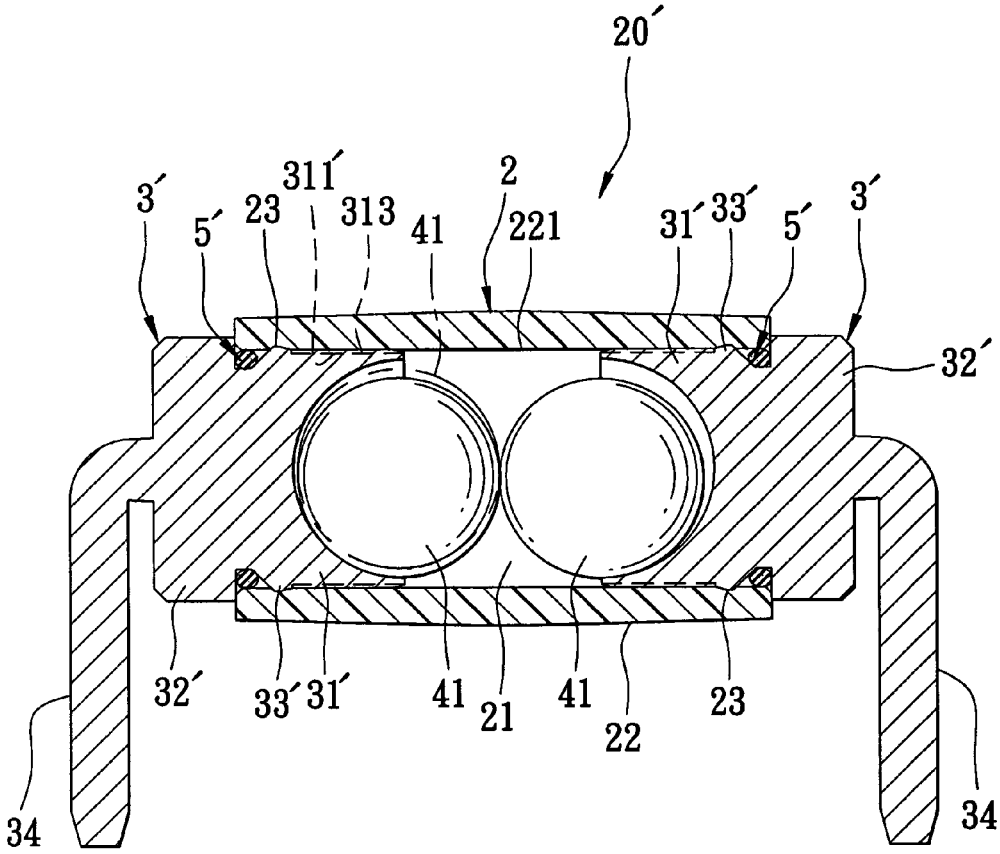
FIG. 10 is a sectional view of FIG. 9 in an assembled state.

Preferably, the insert portion 31' of each lead terminal 3' further has an annular receiving groove 30' adjacent to the end cap portion 32', and a sealing gasket 5' disposed in the annular receiving groove 30', as shown in FIGS. 9 and 10, so as to prevent water from entering the axial hole 21 of the housing 2, and so as to minimized the occurrence of oxidation of the switch 20'.

Figure 11:
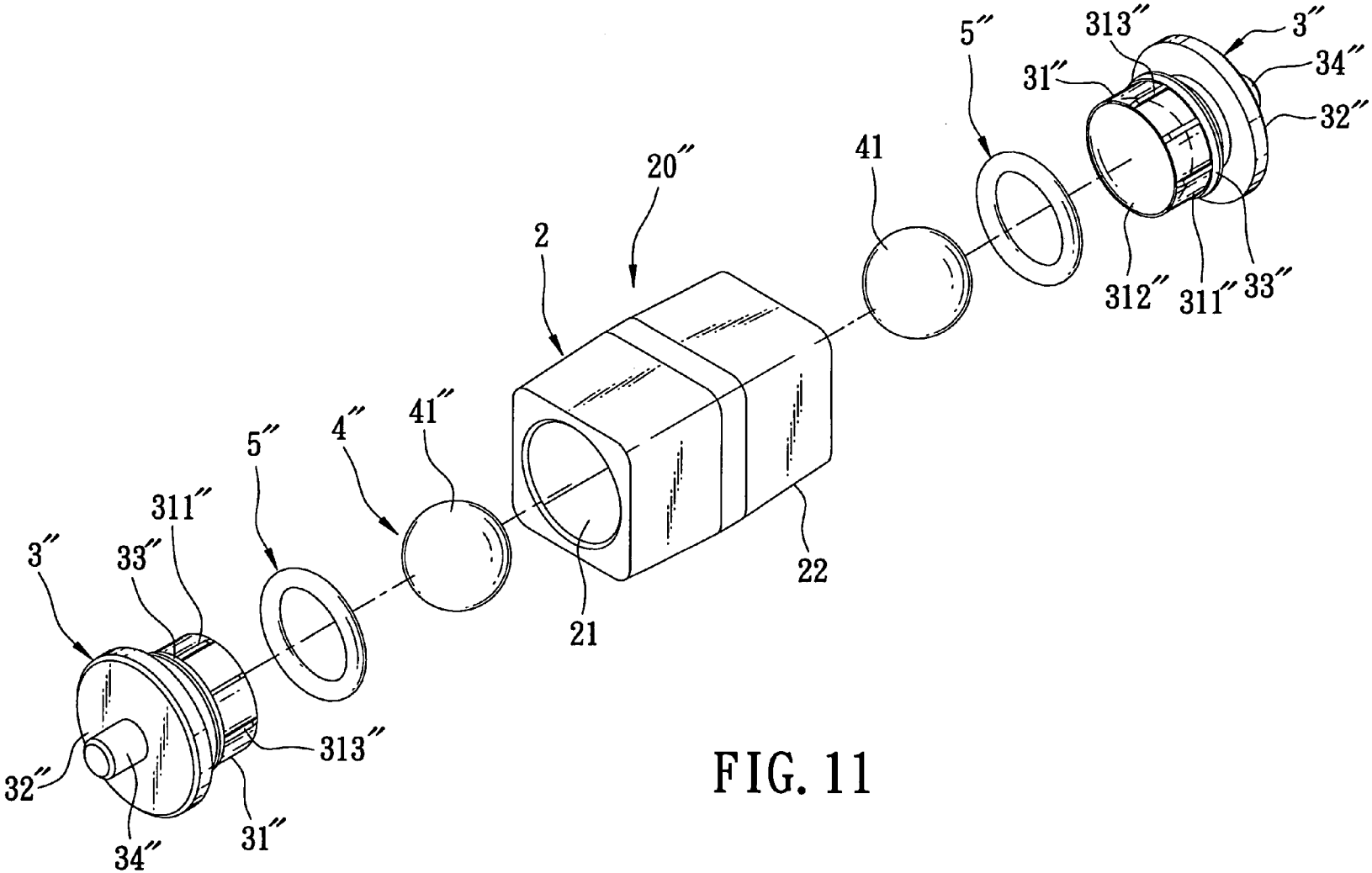
FIG. 11 is an exploded perspective view of the third preferred embodiment of a rolling-ball switch according to the present invention.
Figure 12:
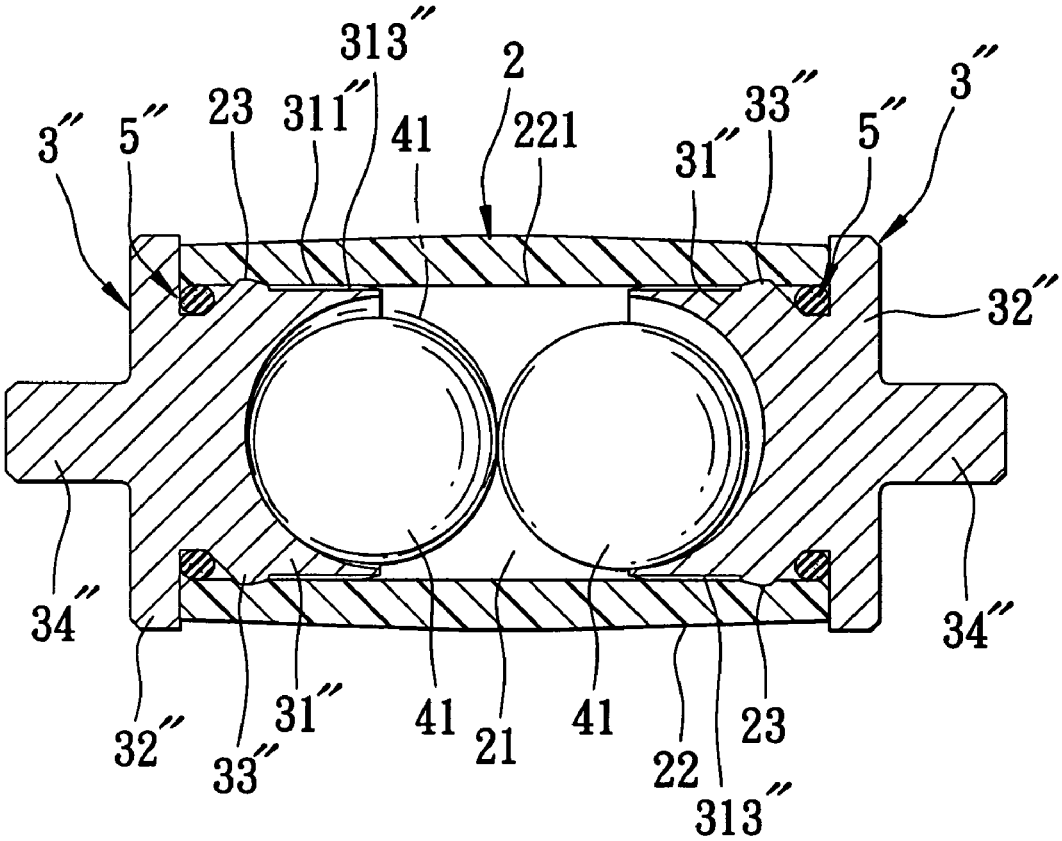
FIG. 12 is an assembled sectional view of the third preferred embodiment.

Referring to FIGS. 11 and 12, the third preferred embodiment of a rolling-ball switch 20" according to the present invention is shown to be similar to the second preferred embodiment. However, in this embodiment, the connecting legs 34" of the lead terminals 3" extend axially, outwardly, and respectively from the end cap portions 32" of the lead terminals 3". The switch 20" may be inserted partially into a notch of a circuit board (not shown), and the connecting legs 34" may be connected conductively to circuit traces of the circuit board.

The advantages of the switch 20, 20', 20" of the present invention are summarized as follows:

1. Since the lead terminals 3, 3', 3" are directly fitted onto the plastic-made housing 2, the need for insulated covers 13 (see FIG. 1) is dispensed herewith. Hence, the components and assembly of the switch 20, 20', 20" are simplified.

2. The lead terminals 3, 3', 3" are stably and non-rotatably connected to the housing 2 through press-fitting contact between the insert portions 31, 31' and the inner wall face 221 of the housing 2, through engagement of the engaging portions 33 of the lead terminals 3 and the respective retaining portions 23 of the housing 2, and through frictional contact between the ribs 313, 313" and the inner wall face 221 of the housing 2. Such a connection of the lead terminals 3, 3', 3" to the housing 2 further ensures that removal of the former from the latter when the switch 20, 20', 20" is subjected to high temperatures does not occur.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A rolling-ball switch comprising:

an insulative housing having an outer surface, a tubular wall that has an axial hole and two opposite open-end portions, each of said open-end portions having an end face and a retaining portion, said retaining portion having an annular engaging groove formed in an inner wall face of said tubular wall;

two lead terminals covering respectively said open-end portions, each of said lead terminals being a one-piece conductive body and being provided with an engaging portion; and a ball unit disposed rollably in said axial hole to contact said lead terminals;

wherein each of said lead terminals includes an insert portion disposed in said axial hole, and an end cap portion extending outwardly of the respective one of said open-end portions and abutting against said end face, said engaging portion having an annular protrusion formed on an outer surface of said insert portion to engage said annular engaging groove;

wherein said outer surface of said insert portion is further formed with a plurality of axial ribs to contact frictionally said inner wall face of said tubular wall, an annular receiving groove adjacent to said end cap portion, and a sealing gasket disposed in said annular receiving groove; and wherein said outer surface of said insulative housing has a middle portion higher than portions at two opposite sides of said middle portion.

2. The rolling-ball switch of claim 1, wherein each of said lead terminals further includes a connecting leg extending outwardly from said end cap portion.

3. The rolling-ball switch of claim 1, wherein said ball unit includes two ball members contacting each other between said insert portions of said lead terminals.

* * * * *